US005674066A

United States Patent [19]

Häusermann et al.

[11] Patent Number: 5,674,066

[45] Date of Patent: Oct. 7, 1997

[54] BURNER

[75] Inventors: Alfred Häusermann, Rieden; Jörg Schmidli, Baden, both of Switzerland

[73] Assignee: Asea Brown Boveri AG, Baden, Switzerland

[21] Appl. No.: 585,889

[22] Filed: Jan. 16, 1996

[30] Foreign Application Priority Data

Jan. 30, 1995 [DE] Germany ..... 195 02 796.5

[51] Int. Cl.[6] ..... F24C 5/00

[52] U.S. Cl. ..... 431/173; 431/350; 431/354

[58] Field of Search ..... 431/350–354, 431/174, 173, 115, 116, 4, 182, 187, 188, 285; 60/39, 464

[56] References Cited

U.S. PATENT DOCUMENTS

| | | | |
|---|---|---|---|
| 4,894,005 | 1/1990 | Keller | 431/351 |
| 5,193,995 | 3/1993 | Keller et al. | 431/351 |

FOREIGN PATENT DOCUMENTS

| | | | |
|---|---|---|---|
| 0321809B1 | 6/1989 | European Pat. Off. . | |
| 0433789A1 | 6/1991 | European Pat. Off. . | |
| 0433790A1 | 6/1991 | European Pat. Off. . | |
| 413283 | 5/1925 | Germany | 431/173 |
| 28736 | 5/1964 | Germany . | |

*Primary Examiner*—James C. Yeung

*Attorney, Agent, or Firm*—Burns, Doane, Swecker & Mathis, L.L.P.

[57] ABSTRACT

The invention relates to a burner (1) which is operated with a lean gas (8) (LBTU gas) and comprises at least two hollow, conical partial bodies (2, 3) which are nested in one another in the direction of flow. By offsetting the longitudinal axes of symmetry (2*a*, 3*a*) relative to one another, tangential ducts (2*b*, 3*b*) are formed through which combustion air (4) flows into the conical cavity (5). Parallel to these ducts (2*b*, 3*b*) there are further ducts (6, 7), formed by dividing walls (6*a*, 7*a*), through which the-lean gas (8) likewise flows into the conical cavity (5) at a similar rate to the combustion air (4).

10 Claims, 3 Drawing Sheets

BURNER

BACKGROUND OF THE INVENTION

1. Field of the Invention

The present invention relates to a premixing burner of conical, double shell construction.

2. Discussion of Background

In the production of steel, a combustible gas with a low calorific value (2–4 MJ/kg) is formed as a byproduct. This "LBTU" gas has hitherto been burnt in gas turbines with thermal outputs of up to 300 MW, using a single burner. In order to burn this gas in modern gas turbines fitted, for example, with an annular combustion chamber, there is a need for individual burners which have a thermal output on the order of less than 20 MW. The difficulty in the construction of a burner that can be operated with LBTU is that the mass ratio of air to fuel is of the order of 1:1, in contrast to a natural-gas fired burner, which is operated at a ratio of 30:1.

U.S. Pat. No. 4,932,861 to Keller et al. has disclosed a burner which permits premix-type combustion and has a number of other advantages which are given thorough consideration in this document. This burner essentially comprises at least two hollow, conical, partial bodies which are mounted adjacent one another to define a conical interior space widening in the direction of flow. The respective longitudinal axes of symmetry of the partial bodies are offset relative to one another, such that the adjacent walls of the partial bodies form in their longitudinal direction tangential ducts for a stream of combustion air. A liquid fuel is preferably injected in the interior space formed by the partial bodies via a central nozzle, while a gaseous fuel is introduced via further nozzles arranged along the longitudinal direction in the region of the tangential ducts.

Even if, with such a burner, a LBTU gas were introduced via all the fuel nozzles present, it would not be possible to achieve the mass ratio of air to fuel required for this purpose.

SUMMARY OF THE INVENTION

Accordingly, one object of the invention is to provide novel measures in the case of a burner of the double shell, cone type stated at the outset which permit operation of this burner with LBTU gas without losing the inherent advantages of this burner.

The essential advantage of the invention is to he seen as the fact that the burner permits operation with LBTU gas, that optimum mixture formation is provided and that, as before, combustion takes place at the outlet of the burner with the formation of a reverse-flow zone, with the minimization of pollutant emissions and at maximized efficiency.

Advantageous and expedient developments of the solution in accordance with the invention to the object are defined in the further, dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
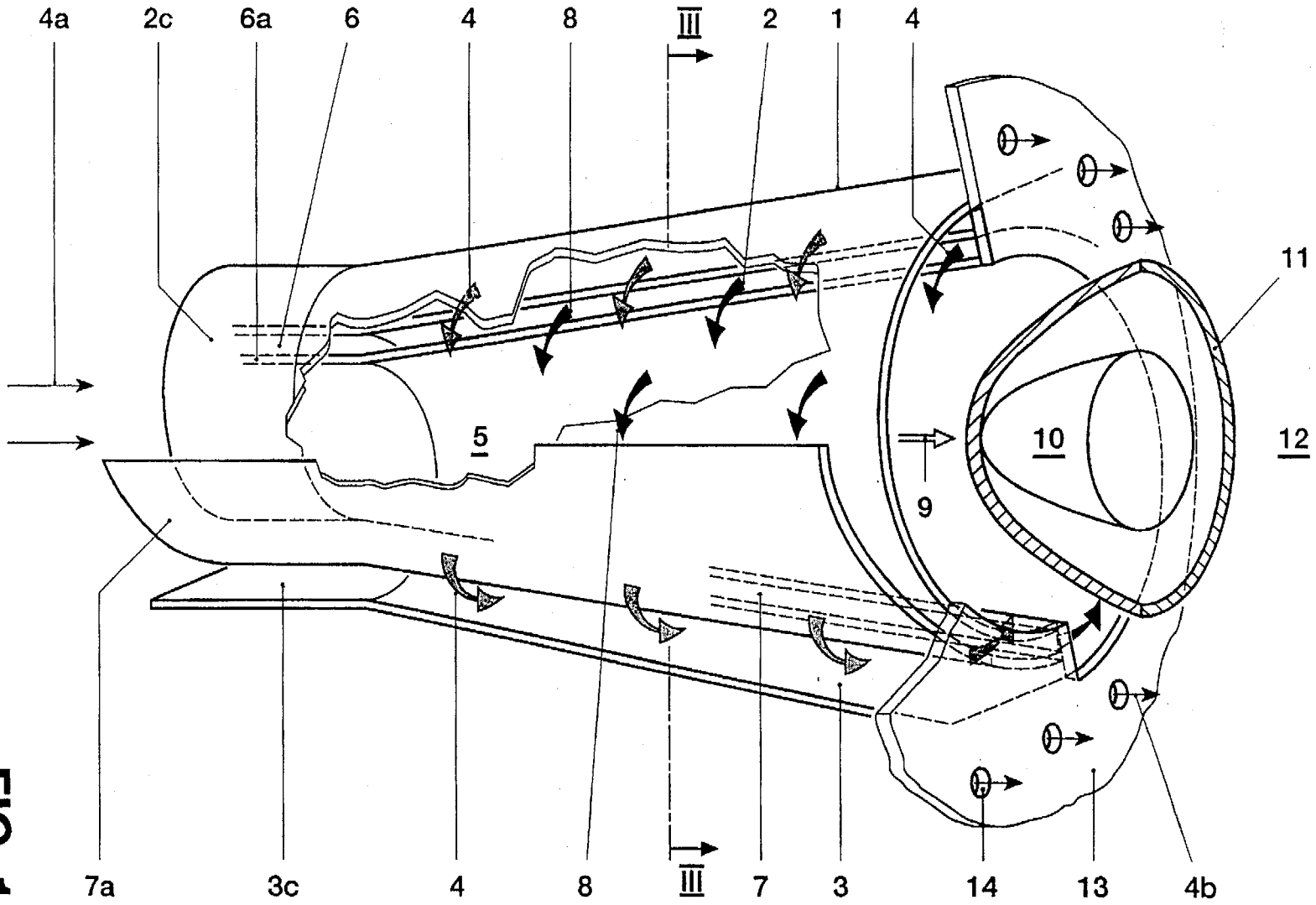
FIG. 1 shows a burner in perspective representation and appropriately cut away and FIG. 2 shows another burner, with a central fuel nozzle.
Figure 3:
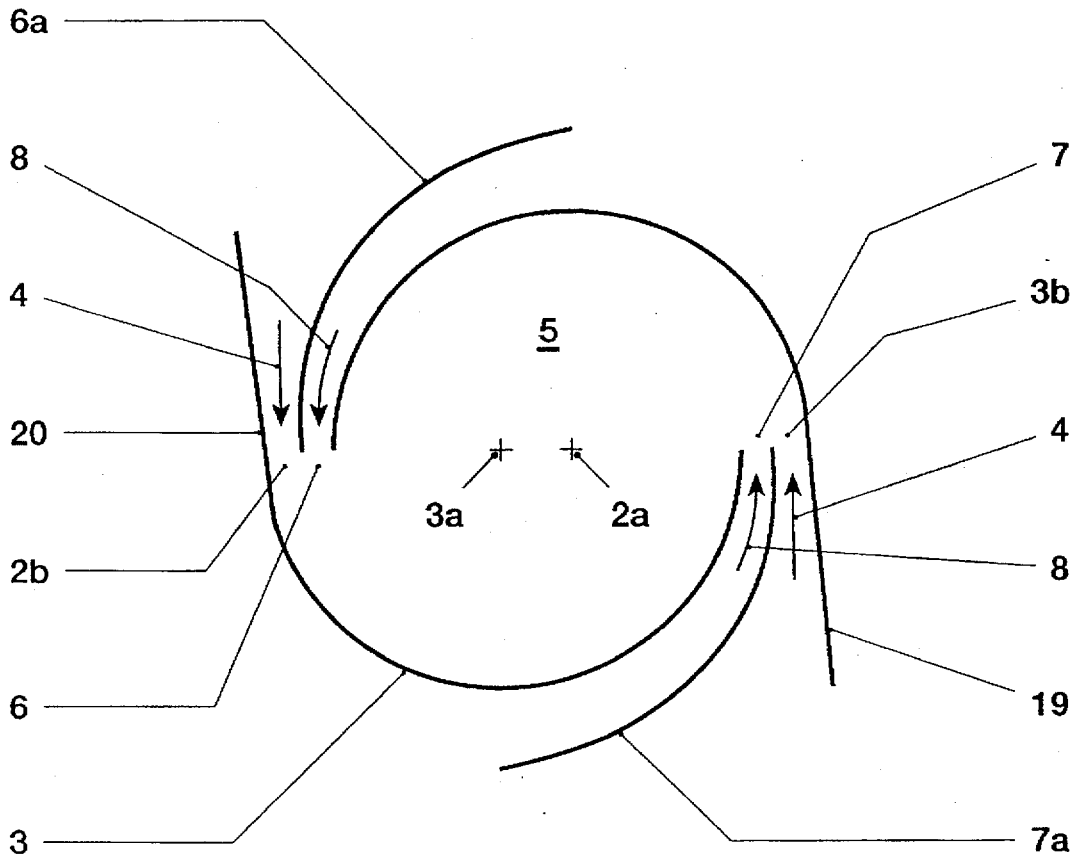
FIG. 3 shows a schematic section through the burner shown in FIG. 1.

In order to better understand the construction of the burner 1, it is advantageous if FIG. 1 is referred to in conjunction with FIG. 3. In order to avoid making FIG. 1 unnecessarily complex, the baffles 19, 20 shown schematically in FIG. 3 have been included in it only in an indicative manner. In the description of FIG. 1, reference is made below to FIG. 3 as required.

Referring now to the drawings, from which all elements which are not required directly for an understanding of the invention have been omitted, wherein like reference numerals designate identical or corresponding parts throughout the several views and wherein the direction of flow of the media is indicated by arrows, in FIG. 1 the burner 1 comprises two hollow conical partial bodies 2, 3, which are mounted adjacent one another to define a conical interior space and respective center lines of the bodies offset relative to one another so that longitudinal side edges of the bodies are spaced apart. The offsetting of the respective center lines or longitudinal axes of symmetry 2*a*, 3*a* (cf. FIG. 3) of the conical partial bodies 2, 3 relative to one another opens up respective tangential air inlet slots 2*b*, 3*b* in mirror symmetry on both sides (cf. FIG. 3), through which the combustion air 4 flows tangentially into the interior of the burner 1, i.e. into the conical cavity 5. The conical shape of the partial bodies 2, 3 shown in the direction of flow has a particular fixed angle. Depending on the service application, the partial bodies 2, 3 can of course have an increasing or decreasing cone inclination in the direction of flow, similar respectively to a trumpet or tulip. The two last-mentioned shapes are not included in the drawing since they can be created without difficulty by the person skilled in the art. The two conical partial bodies 2, 3 each have a cylindrical initial part 2*c*, 3*c* which, like the conical partial bodies 2, 3, likewise run offset relative to one another, with the result that the tangential air inlet slots 2*b*, 3*b* are present over the entire length of the burner 1. The burner 1 can, of course, be of purely conical design i.e. without cylindrical initial parts 2*c*, 3*c*. The two conical partial bodies 2, 3 each have an inwardly offset and likewise tangentially routed duct 6, 7 (cf. also FIG. 3), via which a gaseous fuel 8 is guided into the conical cavity 5. The two streams, namely the combustion air 4 and the gaseous fuel 8, are guided separately as far as the area of the tangential air inlet slots 2*b*, 3*b* by virtue of a dividing wall 6*a*, 7*a* (cf. FIG. 3). In terms of construction, this can be achieved by mounting on the respective partial body 2, 3 a fuel-carrying chamber which has a tangentially directed outlet openings in the region of the said air inlet slots. 2*b*, 3*b*. This ensures that two parallel streams flow into the conical cavity 5 simultaneously. The outlet openings of the two ducts in the direction of the conical cavity 5 should be configured in such a way that they permit an approximately equal mass flow to flow through, as is necessary at all times when the burner 1 is operated with a LBTU gas. In the present case, the gas-carrying duct (6, 7) is routed on the conical-cavity side in relation to the flow of the combustion air 4. The routing of the flow of the media 4, 8 can, of course, be interchanged. The mixing of the two media 4, 8 in the conical cavity 5 takes place in a fairly intensive manner as they flow into the conical cavity 5 past dividing walls 6*a*, 7*a*, due to the reciprocal shear forces which form in the cavity. Given mixing of the combustion air 4 and LBTU gas 8 initiated in this way, an optimum, homogeneous mixture 9 across the cross section is achieved at the end of the burner 1. If the combustion air 4 is additionally preheated or enriched with a recirculated exhaust gas, this greatly assists the degree of mixing of the two media 4, 8. With respect to the cone angle and the width of the tangential air inlet slots 2*b*, 3*b*, narrow limits have to be maintained per se to ensure that the desired flow field of the mixture 9 can be established at the outlet of the burner 1. This flow field is dependent on the swirl numbers established in the burner 1 itself. The aim in this design is to ensure that the critical swirl number is established at the outlet of the burner 1: it is in the plane of the critical swirl number that a reverse-flow zone (vortex breakdown) 10 is formed too, initiating a stabilizing action on the flame front 11. The widening in cross section provided there between the cross section of flow of the burner 1 and the combustion space 12 initiates peripheral vortex separations which further stabilize the flame front 11 such that radial flattening of the reverse-flow zone 10 and flashback of the flame 11 into the interior of the burner 1 are prevented. In general, it can be stated that, for a given cone configuration of the partial bodies 2, 3, the critical swirl number is established more rapidly by means of a reduction in the tangential air inlet slots 2*b*, 3*b*, with the result that the reverse-flow zone 10 coinciding with the critical swirl number is, under certain circumstances, established even before the outlet of the burner 1. For its part, the axial velocity within the burner 1 can be altered by providing an appropriately large supply of an axial combustion-air stream 4*a*. The construction of the burner 1 is moreover eminently suitable for altering the size of the tangential air inlet slots 2*b*, 3*b*, thereby making it possible to encompass a relatively large operating range without altering the overall length of the burner 1. The partial bodies 2, 3 are, of course, also displaceable in another plane relative to one another, thereby even making it possible to bring about an overlap between them. It is furthermore possible to nest the partial bodies 2, 3 in the manner of a spiral in one another by means of an opposed rotary motion. It is thus possible to vary the shape, the size and the configuration of the tangential air inlet slots 2*b*, 3*b* as desired and the burner 1 can thus, in turn, cover a wide range of operating conditions without alteration to its overall length. As regards the shape and configuration of the tangential air inlet slots 2*b*, 3*b*, these can readily assume a conically decreasing (taper) or increasing flow shape (widening) to further influence the critical swirl number in the direction of flow. For the purpose of better understanding, the tapering of the air inlet slots in the direction of flow will be explained, by way of example: here there is an increasing mass flow along the axis, the axial component thus being larger than the radial component. When translated into the swirl number, this has the effect that a tapering slot width in the direction of flow shifts the reverse-flow zone 10 upstream. Since there is a relationship of interdependence between the tangential air inlet slots 2*b*, 3*b* for the inflow of the combustion air 4 and those 6, 7 for the introduction of a LBTU gas 8 as regards the flow rate, the shapes and size of the respective slots should be matched to one another in an appropriate manner. Approximately in the plane of the reverse-flow zone 10, the outlet opening of the burner 1 merges into a front wall 13 in which there are a number of holes 14. These come into action when required and ensure that diluting or cooling air 4*b* is supplied to the initial zone of the combustion space 12. The various air streams 4, 4*a*, 4*b* do not necessarily have to have the same pressure, the same temperature or the same composition.

Figure 2:
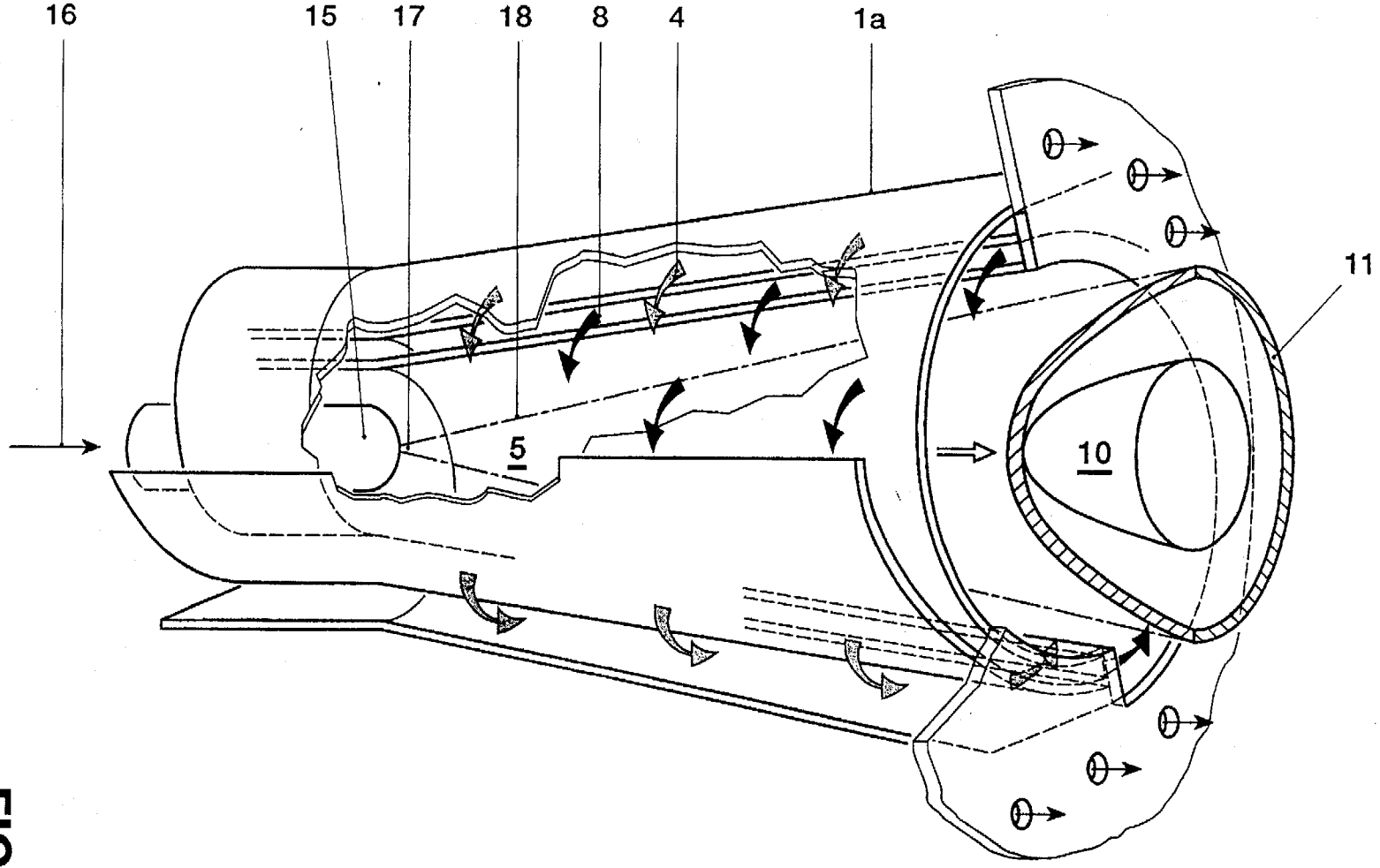

FIG. 2 shows an identical burner construction to that in FIG. 1, this burner la being fitted with a central fuel nozzle 15 which acts as the head stage of this burner la. This nozzle 15 can per se also be operated with a gaseous fuel. It is moreover also possible to operate this nozzle with a liquid fuel 16, this burner 1*a* being operated solely by means of the said nozzle 15 or in conjunction with the gaseous fuel 8, which is introduced via the slots provided tangentially for that purpose (cf. FIGS. 1, 3). During the introduction of a liquid fuel 16 via the nozzle 15, a conical fuel profile 18 is formed in the conical cavity 5 owing to the acute angle 17 set there, this conical fuel profile being jacketed by the combustion air 4 flowing in tangentially and with a swirl. The concentration of the fuel 16 is progressively reduced in the axial direction by the inflowing combustion air 4, to give a mixture. Even when a liquid fuel 16 is introduced via the said nozzle 15, the optimum, homogeneous concentration across the cross section is achieved at the outlet of the burner 1*a*. If the combustion air 4 is preheated or enriched with a recirculated exhaust gas, the vaporization of the liquid fuel 16 is markedly increased, such that a reverse-flow zone 10 and a flame front 11 are formed at the outlet of the burner la just as explained with reference to FIG. 1. Particularly in the case of lean gases, introduction is difficult to achieve by means of a single nozzle because of the large fuel mass required for this purpose. In such circumstances, the configuration shown in FIG. 1 is used.

FIG. 3 reveals the geometrical configuration of the baffles 19, 20 and of the remaining structure of the burner. These baffles 19, 20 have the function of introducing flow and they can be of various configurations. The ducting of the combustion air 4 into the conical cavity 5 can be appropriately optimized by opening or closing these baffles 19, 20, for example about a center of rotation (not shown) in the region of the tangential air inlet slots 2*b*, 3*b*. These dynamic measures can, of course, also be provided in static form if baffles corresponding to requirements form a fixed component together with the conical partial bodies 2, 3. The burner can likewise also be operated without baffles or other means can be provided for this purpose. FIG. 3 also reveals the positioning of the inflow of the gaseous fuel 8, to the inside of the combustion air 4. The dividing walls 6*a*, 7*a* touched upon in the context of FIG. 1, which form respective ducts for the two media 4, 8, can now be seen clearly from FIG. 3.

Obviously, numerous modifications and variations of the present invention are possible in light of the above teachings, it is therefore to be understood that within the scope of the appended claims, the invention may be practiced otherwise than as specifically described herein.

What is claimed as new and desired to be secured by letters patent of the United States is:

1. A burner comprising at least two hollow, conical partial bodies mounted adjacent one another to define a conical interior space widening in a direction of flow to an outlet end, longitudinal axes of symmetry of the bodies being offset relative to one another so that adjacent edges of the partial bodies form in a longitudinal direction first ducts for a tangentially directed flow of combustion air into the interior space of the burner, and a second duct substantially parallel with each first duct for carrying fuel tangentially into the interior space of the burner, an outlet of the first duct and an outlet of the second duct being positioned to simultaneously deliver separate flows to the interior space.

2. The burner as claimed in claim 1, wherein the second tangential ducts are connected to a source of gaseous fuel for introducing gaseous fuel into the interior of the burner.

3. The burner as claimed in claim 1, wherein a size of a flow cross section of the fuel-carrying second ducts relative to that of the air-carrying first ducts is selected for a calorific value of a fuel being injected.

4. The burner as claimed in claim 1, further comprising at least one further fuel nozzle mounted as a head stage at an inlet end of the burner interior space.

5. The burner as claimed in claim 4, wherein the fuel nozzle includes means for delivering a liquid fuel to the fuel nozzle.

6. The burner as claimed in claim 1, wherein the fuel-carrying second ducts are arranged on a radially interior side in relation to the air carrying first ducts.

7. The burner as claimed in claim 1, wherein the partial bodies are nested in one another in a spiral pattern.

8. The burner as claimed in claim 1, wherein the partial bodies widen at a fixed angle in the direction of flow.

9. The burner as claimed in claim 1, wherein a flow cross section of the burner increases in the direction of flow.

10. The burner as claimed in claim 1, wherein a flow cross section of the burner decreases in the direction of flow.

* * * * *